US010340625B2

(12) United States Patent
Umemura et al.

(10) Patent No.: US 10,340,625 B2
(45) Date of Patent: Jul. 2, 2019

(54) SHIELD CONNECTOR

(71) Applicants: SUMITOMO WIRING SYSTEMS, LTD., Yokkaichi-shi, Mie (JP); TOYOTA JIDOSHA KABUSHIKI KAISHA, Toyota-shi, Aichi (JP)

(72) Inventors: Kenji Umemura, Mie (JP); Yusuke Sakamoto, Toyota (JP)

(73) Assignees: SUMITOMO WIRING SYSTEMS, LTD. (JP); TOYOTA JIDOSHA KABUSHIKI KAISHA (JP)

( * ) Notice: Subject to any disclaimer, the term of this patent is extended or adjusted under 35 U.S.C. 154(b) by 0 days.

(21) Appl. No.: 15/745,576

(22) PCT Filed: Jul. 7, 2016

(86) PCT No.: PCT/JP2016/070120
§ 371 (c)(1),
(2) Date: Jan. 17, 2018

(87) PCT Pub. No.: WO2017/014057
PCT Pub. Date: Jan. 26, 2017

(65) Prior Publication Data

US 2018/0212354 A1 Jul. 26, 2018

(30) Foreign Application Priority Data

Jul. 22, 2015 (JP) ..... 2015-144619

(51) Int. Cl.
*H01R 13/52* (2006.01)
*H01R 13/6581* (2011.01)

(52) U.S. Cl.
CPC ..... *H01R 13/52* (2013.01); *H01R 13/5213* (2013.01); *H01R 13/6581* (2013.01)

(58) Field of Classification Search
CPC ..... H01R 13/6598; H01R 13/6596; H01R 12/596
(Continued)

(56) References Cited

U.S. PATENT DOCUMENTS 6,669,511 B1 * 12/2003 Yagi ..... H01R 4/646 439/607.44
7,041,907 B2 * 5/2006 Miyazaki ..... H01R 13/6581 174/359
(Continued)

FOREIGN PATENT DOCUMENTS

JP 2009117306 5/2009
JP 2013186955 9/2013
(Continued)

OTHER PUBLICATIONS

International Search Report dated Aug. 9, 2016.

*Primary Examiner* — Tulsidas C Patel
*Assistant Examiner* — Marcus E Harcum
(74) *Attorney, Agent, or Firm* — Gerald E. Hespos; Michael J. Porco; Matthew T. Hespos

(57) ABSTRACT

A device connector disclosed herein is a shield connector configured to be attached to a casing of a device installed in an engine room of a vehicle and including a metal shield bracket to which a flexible metal shield conductor is connected. The shield connector includes a housing fixed to the bracket, a shield connecting member, a cover, and a water blocking wall. The shield connecting member includes a conductor connecting portion that is a bendable metal plate. The conductor connecting portion is bent to sandwich an upper end portion of the shield conductor and screwed to the shield bracket to electrically connect the shield conductor to the shield bracket. The cover includes a shell cover that covers the housing. The water blocking wall is in a lower
(Continued)

end portion of the shell cover to cover left, right, and rear sides of a bent portion of the conductor connecting portion.

8 Claims, 6 Drawing Sheets

(58) Field of Classification Search
USPC .. 439/98, 939, 108, 607.28, 607.41, 607.48, 439/607.49, 607.55
See application file for complete search history.

(56) References Cited

U.S. PATENT DOCUMENTS 7,572,150 B2 * 8/2009 Matsuoka ..... H01R 13/207 439/626
7,959,469 B2 * 6/2011 Kawamura ..... H01R 13/6593 439/573
8,152,574 B2 * 4/2012 Matsuoka ..... H01R 4/302 439/587
8,317,544 B2 * 11/2012 Matsuoka ..... H01R 4/64 439/607.55
8,545,265 B2 * 10/2013 Sakamoto ..... B29C 45/14 439/606
8,827,747 B2 * 9/2014 Tanaka ..... H01R 13/6581 439/607.27
9,281,627 B2 * 3/2016 Fujiwara ..... H01R 13/6581
9,318,849 B2 * 4/2016 Kobayashi ..... H01R 13/5205
9,674,994 B2 * 6/2017 Yoshida ..... H01R 13/6593
9,722,361 B2 * 8/2017 Tanaka ..... H01R 13/6592
9,742,124 B2 * 8/2017 Kusamaki ..... H01R 9/034
9,806,454 B2 * 10/2017 Nakai ..... B60R 16/0222
2004/0057187 A1 * 3/2004 Kuboshima ..... H01R 9/032 361/118
2004/0266265 A1 * 12/2004 Hayashi ..... H01R 13/5221 439/607.53
2008/0280467 A1 * 11/2008 Tsuji ..... H01R 13/4223 439/135
2010/0255728 A1 10/2010 Matsuoka et al.
2014/0106588 A1 * 4/2014 Suzuki ..... H01R 13/5219 439/271
2014/0295709 A1 * 10/2014 Tanaka ..... H01R 13/405 439/626
2015/0027772 A1 * 1/2015 Hashimoto ..... B60R 16/0215 174/382
2016/0380390 A1 12/2016 Kusamaki et al.

FOREIGN PATENT DOCUMENTS

JP 2015095355 5/2015
JP 2015153591 8/2015

* cited by examiner

SHIELD CONNECTOR

BACKGROUND

1. Field of the Invention

The technology disclosed herein relates to a shield connector.

2. Description of the Related Art

For example, Japanese Unexamined Patent Application Publication No. 2013-186955 describes a shield connector with a shield shell to which a braided wire, which covers electric wires, is connected. The end portion of the braided wire covers the shield shell of the connector, and swaging is performed with a swaging ring being attached to an outer side of the braided wire to electrically connect the braided wire and the shield shell.

As a way to electrically connect the braided wire and the shield shell, use of a metal shield connecting member has been discussed. An L-like shaped conductor connecting portion of the shield connecting member is folded in half to sandwich the braided wire, and an attachment piece integrally included in the conductor connecting portion is screwed to the shield shell to electrically connect the braided wire and the shield shell to each other.

However, in such a shield connecting member, since the conductor connecting portion is folded to sandwich the braided wire, a plated layer for rust proofing at the bent portion, where the conductor connecting portion is folded, may be chipped away when the conductor connecting portion is folded. Thus, when the shield connecting member is disposed in an engine room of a vehicle or the like, the shield connecting member may get rust if gets rain water, for example, on the bent portion.

This specification discloses a technology of preventing the bent portion of the shield connecting member from being exposed to water.

SUMMARY

The technology disclosed herein relates to a shield connector configured to be attached to a casing of a device and including a bracket made of metal to which a flexible shield conductor made of metal is connected. The shield connector includes a housing fixed to the bracket, a shield connecting member, a cover, and a water blocking wall. The shield connecting member includes a conductor connecting portion that is a bendable metal plate. The cover covers the housing. The water blocking wall is included in the cover and covers an outer surface of a bent portion of the conductor connecting portion. The conductor connecting portion that is bent sandwiches an end portion of the shield conductor. The conductor connecting portion is connected and fixed to the bracket to electrically connect the shield conductor to the bracket.

In the shield connector having such a configuration, the water blocking portion covering the bent portion prevents the bent portion from being exposed to rain, for example. Thus, the shield connecting member is unlikely to get rusted.

The shield connector disclosed herein may have the following configurations.

The housing may include a plurality of electric wire draw-out portions located side by side to draw out electric wires. The bent portion may be horizontally long along the shield conductor covering the plurality of electric wire draw-out portions. The water blocking wall may have a plate-like shape and may be horizontally longer than the bent portion. The water blocking wall may include a reinforcing portion protruding to an outer side away from the shield connecting member.

For example, the water blocking wall having a horizontally long plate shape has a risk of warping or deformation in the thickness direction.

However, in the above-described configuration, the reinforcing portion included in the water blocking wall prevents the water blocking wall from being deformed. Thus, the bent portion is unlikely to be exposed to rain water or the like due to deformation of the water blocking wall.

In some cases, the water blocking wall may include a reinforcing portion protruding toward the shield connecting member to prevent deformation of the water blocking wall.

However, if the reinforcing portion protruding toward the shield connecting member protrudes too much to the front side in the production, the reinforcing portion may be in contact with the shield connecting member, for example, preventing the cover from being positioned at the normal position. To prevent the contact with the shield connecting member, the water blocking wall may be moved to the rear side in consideration of the large protrusion. In such a case, the cover has a larger size in the front-back direction.

In the above-described configuration, which includes the reinforcing portion protruding to the outer side, the reinforcing portion and the shield connecting member are not in contact with each other.

The reinforcing portion may be protruded to the outer side at a position away from an edge of the water blocking wall and closer to the middle.

The reinforcing portion of the water blocking portion protruding to the outer side may be obtained by bending an edge of the water blocking wall outwardly. In such a case, the tip of the edge protrudes to the outer side when the edge is bent to the outer side to form the reinforcing portion, and the tip of the edge may come in contact with and damage another component. However, in the above-described configuration, the reinforcing portion protrudes at a position away from the edge of the water blocking wall and closer to the middle. Thus, the tip does not protrude to the outer side, and the tip is unlikely to be in contact with another component.

The reinforcing portion may be horizontally longer than the bent portion. With this configuration, the water blocking wall is reinforced over an area larger than that of the bent portion. Compared to a configuration having a reinforcing portion shorter than the bent portion, this configuration reliably prevents the water blocking wall covering the bent portion from being deformed.

The cover may include a shell cover made of metal and fixed to the bracket with a fixing bolt, and the shell cover may integrally include the water blocking wall at an end portion.

In this configuration, the metal shell cover integrally includes the water blocking wall at the end portion. Thus, the water blocking wall has higher rigidity than a water blocking wall made of synthetic resin. The water blocking wall is further unlikely to be deformed.

The technology disclosed herein prevents the bent portion of the shield connecting member from being exposed to water.

DETAILED DESCRIPTION

One embodiment is described with reference to FIG. 1 to FIG. 6.

Figure 1:
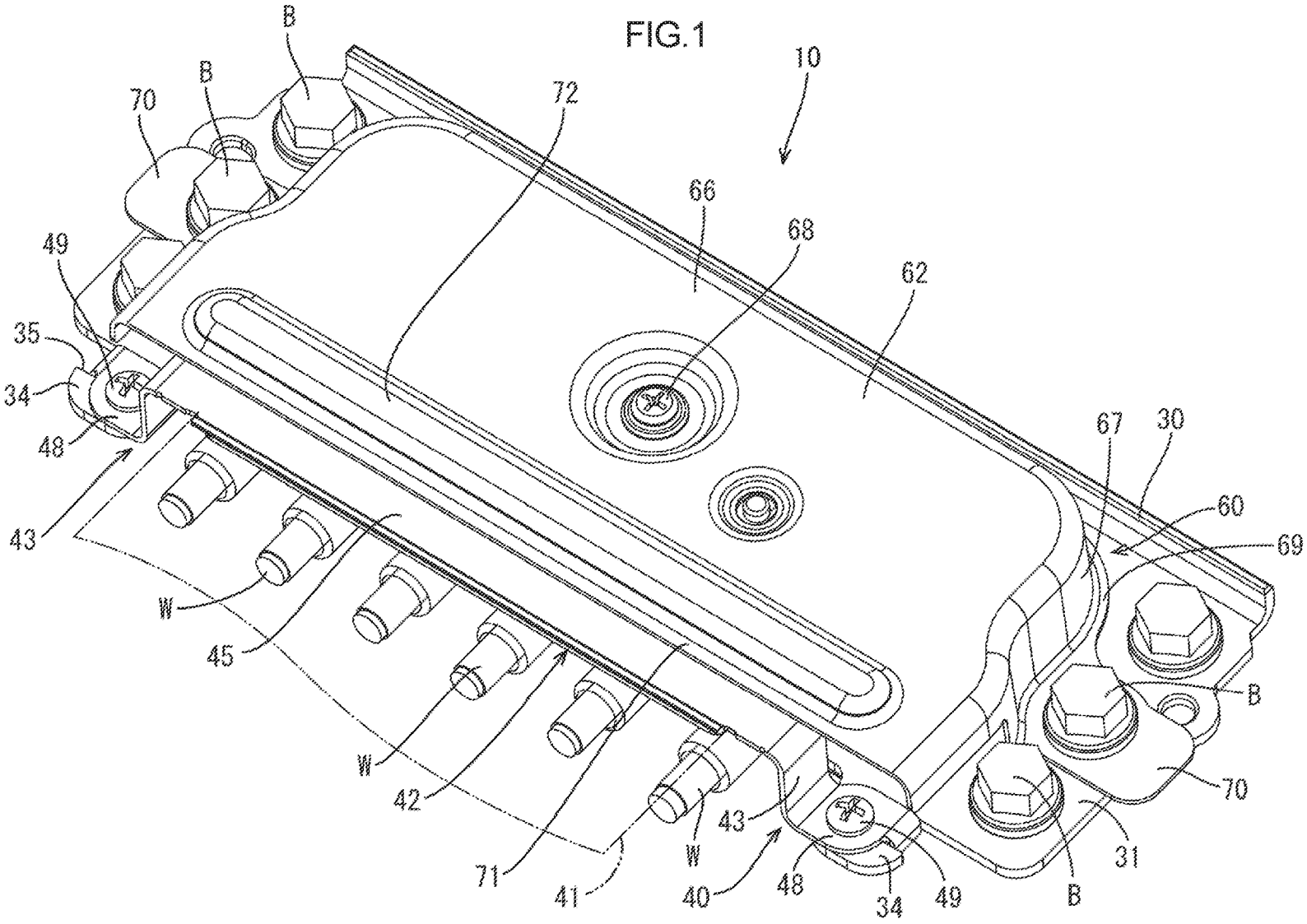
FIG. 1 is a perspective view of a device connector.

As illustrated in FIG. 1, in this embodiment, a device connector (one example of a "shield connector") 10 having a shielding function and configured to be attached to a casing C of a device to be mounted in an engine room of a vehicle is described as an example. In the following description, the front-back direction is based on the left-right direction in FIG. 3, FIG. 4, and FIG. 6, and a side of the device connector 10 which is attached to the casing C is referred to as a front side.

Figure 3:
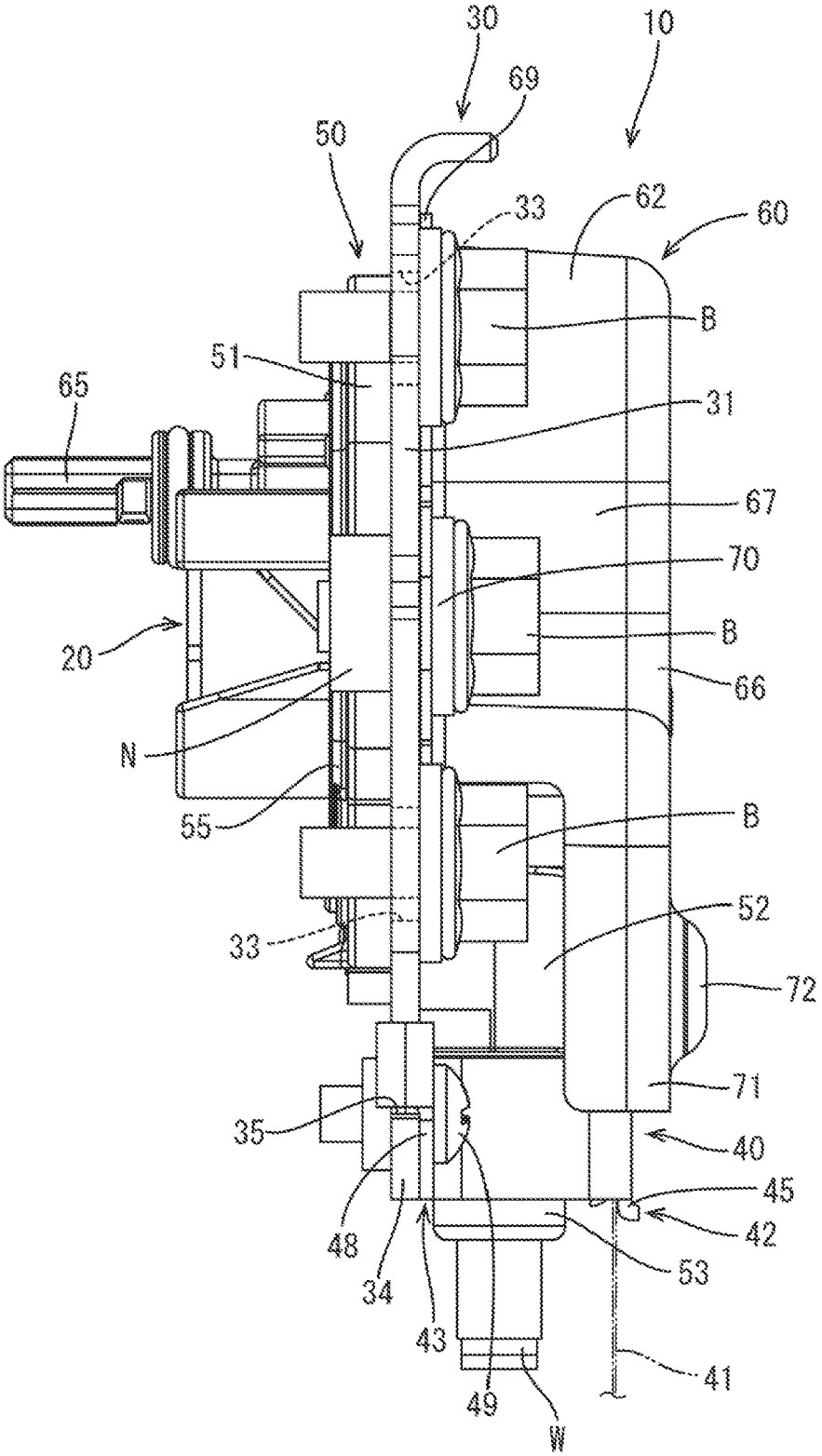
FIG. 3 is a side view of the device connector.
Figure 4:
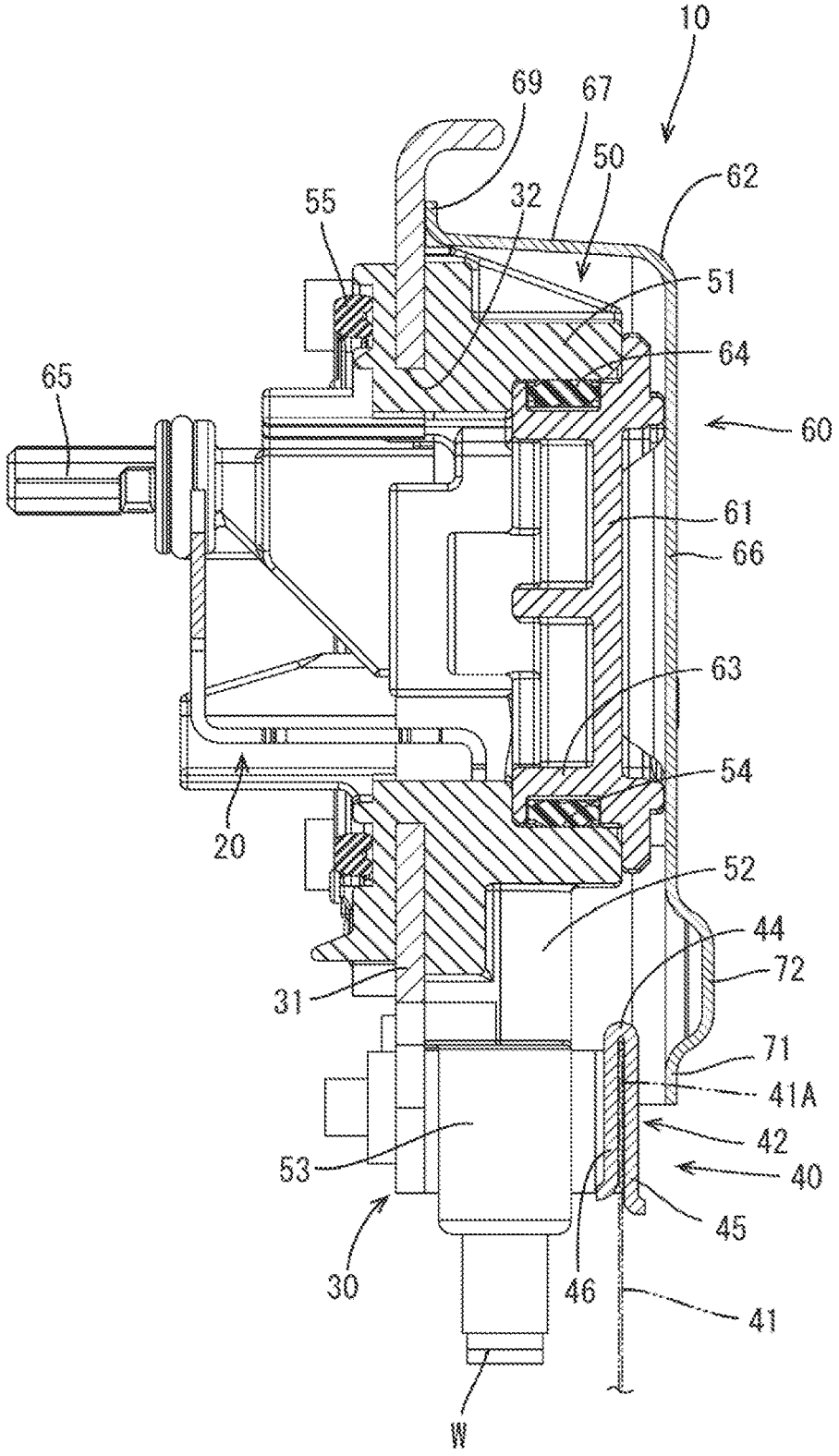
FIG. 4 is a cross-sectional view taken along line A-A in FIG. 2.

As illustrated in FIG. 1, FIG. 3, and FIG. 4, the device connector 10 includes terminals 20 connected to terminals of electric wires W and configured to be connected to device terminals (not illustrated) in the casing C, a shield bracket (one example of a "bracket") 30 having a planar plate body 31, a shield connecting member 40 connected to the shield conductor 41 covering the electric wires W and connected and fixed to the shield bracket 30, and a housing 50 integrally formed with the terminals 20 and the shield bracket 30 and made of synthetic resin, and a cover 60 attached to the housing 50 from the rear side.

Figure 6:
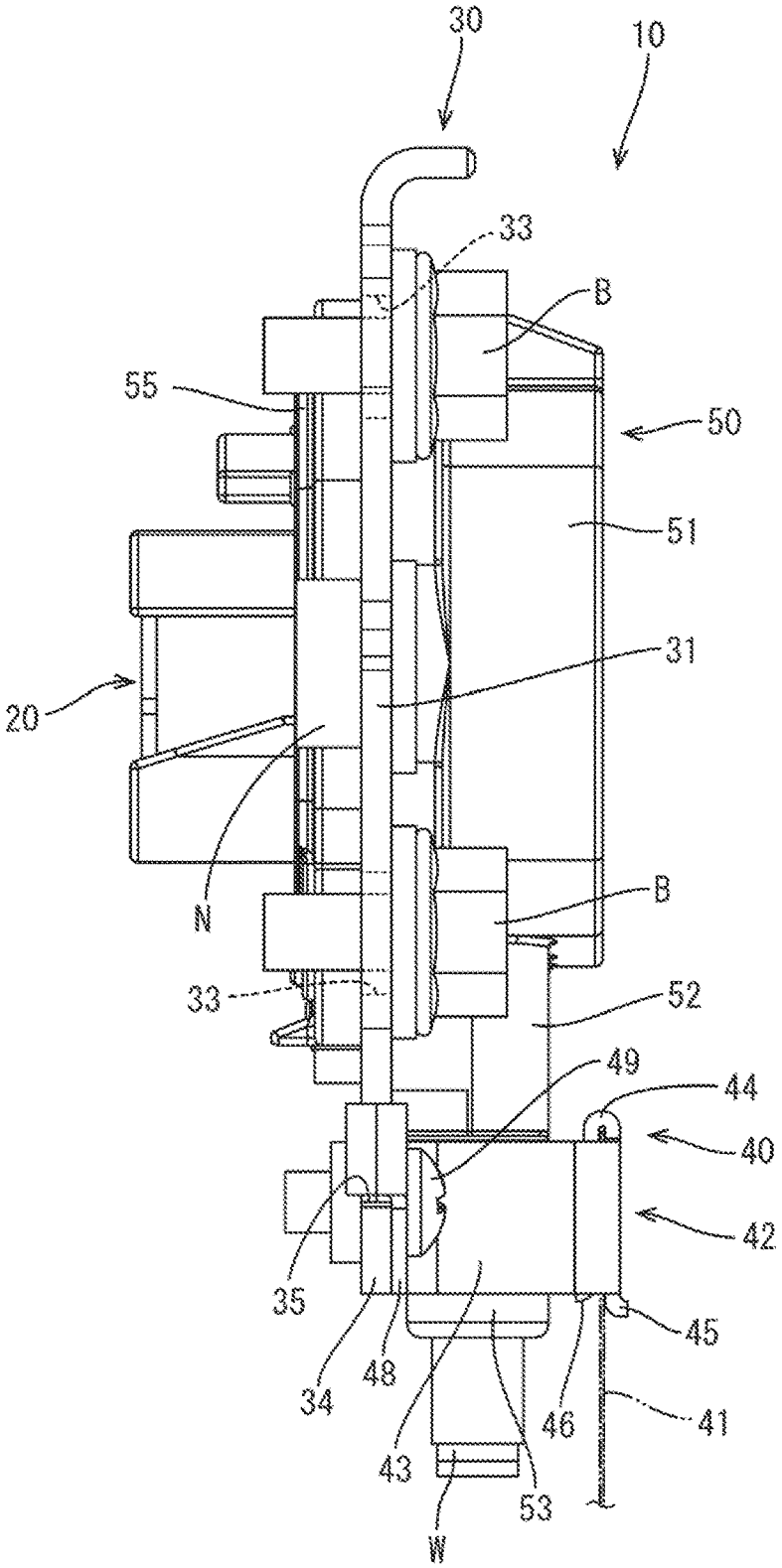
FIG. 6 is a side view of FIG. 5.

As illustrated in FIG. 4 and FIG. 6, the housing 50 includes a tubular portion 51 having a tubular shape and holding the terminals 20, a plurality of electric wire draw-out portions 53 for drawing out the electric wires W connected to the terminals 20 downward, and a connection portion 52 integrally formed with the tubular portion 51 and the electric wire draw-out portions 53 to connect the tubular portion 51 and the electric wire draw-out portions 53 to each other.

The tubular portion 51 is horizontally long, i.e., long in the left-right direction, and has front and rear openings. The rear opening of the tubular portion 51 is an operation hole 54 through which a tool (not illustrated) for connecting the device terminals and the terminals 20 are inserted.

In the tubular portion 51, the terminals 20 supported by the inner wall of the tubular portion 51 are located side by side in the left-right direction.

The terminals 20 each have a crank-shape having a front end portion extending upward. The terminals 20 each extend upward from a lower surface of the inner wall of the tubular portion 51 and turn and extend frontward and then upward in a bent form. The terminals 20 are held in the tubular portion 51 with the front end portions protruding frontward from the front opening of the tubular portion 51.

Furthermore, as illustrated in FIG. 4, a portion of the plate body 31 around a through hole 32 extending through the plate body 31 of the shield bracket 30 in the front-back direction is buried in the peripheral wall of the tubular portion 51. Thus, the tubular portion 51 is integrated with the shield bracket 30. The tubular portion 51 extends through the plate body 31 in the front-back direction.

A seal packing 55 extending along the front opening edge of the tubular portion 51 is attached to a portion of the tubular portion 51 located in front of the portion where the plate body 31 of the shield bracket 30 is buried. When the device connector 10 is attached to the casing C, the seal packing 55 is sandwiched between the outer surface of the casing C and the front surface of the tubular portion 51 in the front-back direction and functions as a water stop between the casing C and the housing 50.

Figure 5:
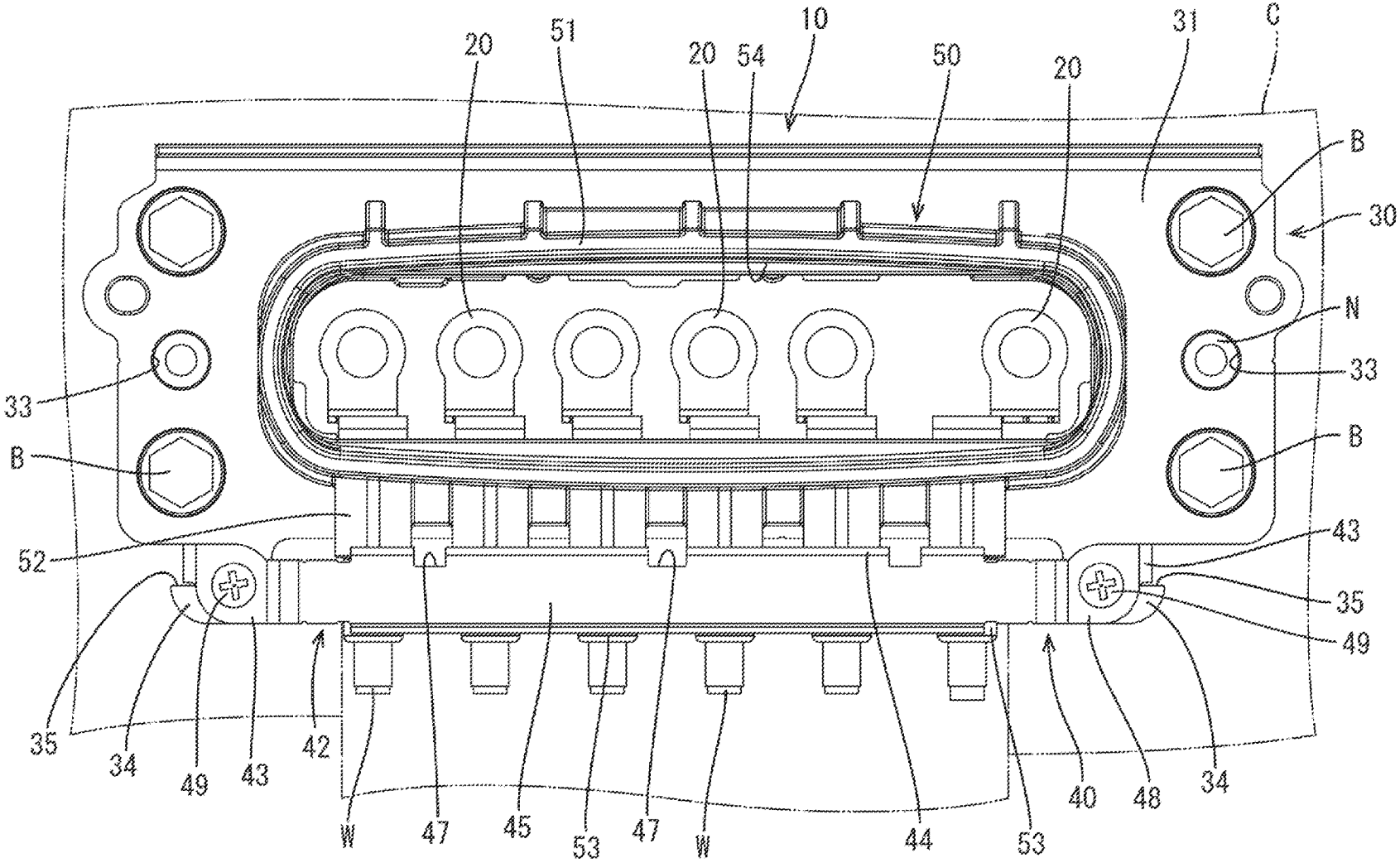
FIG. 5 is a plan view of the device connector without a shell cover.

As illustrated in FIG. 4 and FIG. 5, the connection portion 52 has a horizontally long block shape, which is long in the left-right direction, and fills the portion where the terminal 20 and the electric wire W are connected to each other.

The electric wire draw-out portions 53 each have a cylindrical shape extending along the electric wire W and to draw the electric wire W out of the lower end of the connection portion 52 downward. The electric wire draw-out portions 53 are located next to each other with an equal distance therebetween in the left-right direction at the lower end of the connection portion 52.

Figure 2:
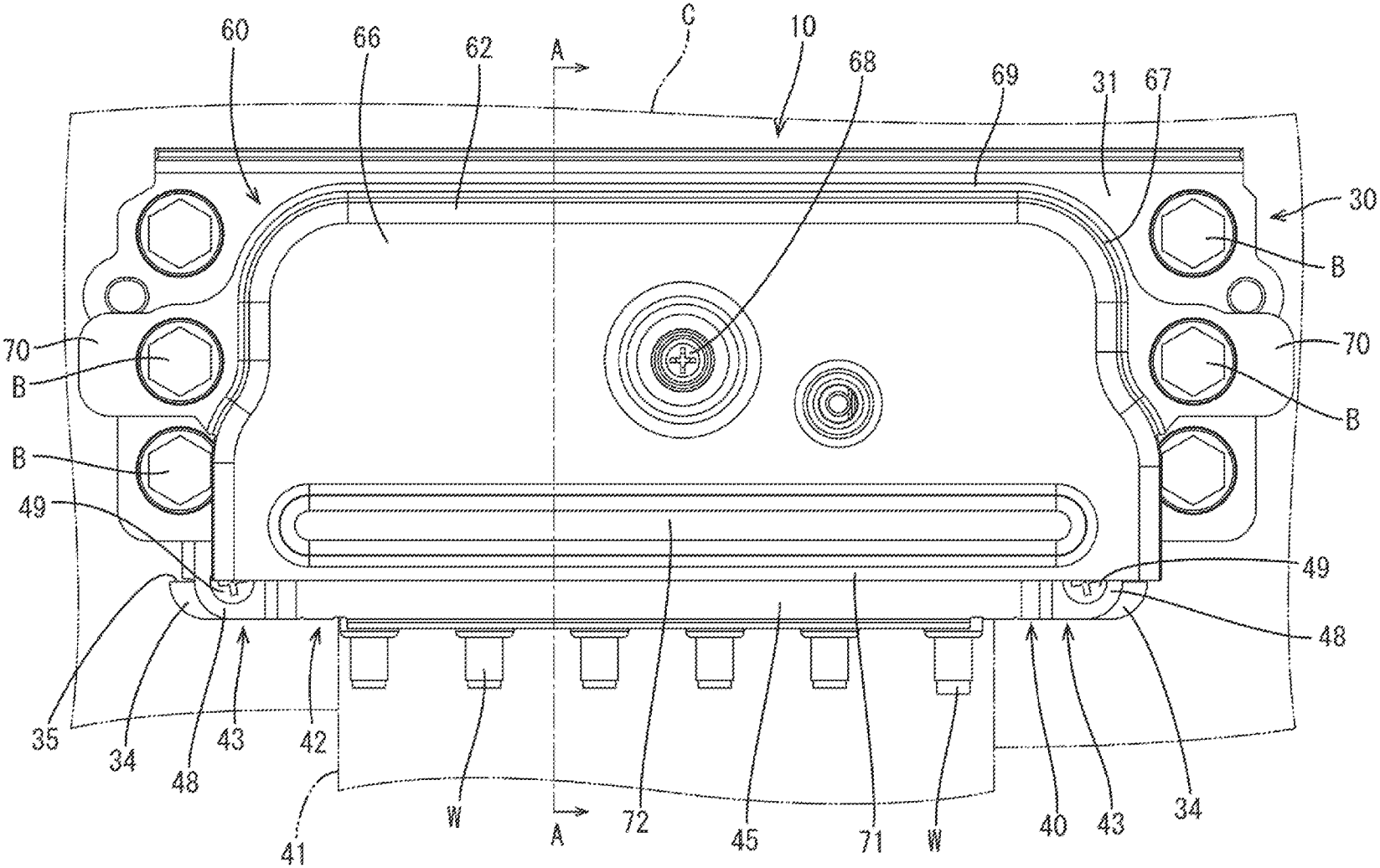
FIG. 2 is a plan view of the device connector.

The shield bracket 30 is made of metal, and the plate body 31 has a substantially horizontally long rectangular shape, which is long in the left-right direction, as illustrated in FIG. 1 and FIG. 2. The plate body 31 has three bolt insertion holes 33 arranged next to each other in the up-down direction at each of the left end portion and the right end portion. The bolt insertion holes 33 extend through the plate body 31 in the front-back direction, which is the thickness direction. As illustrated in FIG. 3 and FIG. 6, fixing bolts B are inserted into the top and bottom bolt insertion holes 33 of the three bolt insertion holes 33, and the fixing bolts B are each fastened to fastening seat (not illustrated) on the casing C. Thus, the shield bracket 30 is fixed to the casing C by the four fixing bolts B.

In other words, since the shield bracket 30 is fixed to the casing C with the four fixing bolts B, the housing 50 is kept attached to the casing C.

Furthermore, as illustrated in FIG. 3 and FIG. 5, a nut N for tightening the fixing bolt B is fixed to a peripheral portion of the middle bolt insertion hole 33, which is one of three bolt insertion holes 33 arranged in the up-down direction, on the front surface of the plate body 31.

As illustrated in FIG. 1 and FIG. 5, two supporting pieces 34, to which the shield connecting member 40 is connected and fixed, are disposed at a lower end of the plate body 31. The two supporting pieces 34 are located slightly inward of the left and right ends of the plate body 31 and located on the left and right sides of the area of the housing 50 where the electric wire draw-out portions 53 are disposed.

The supporting pieces 34 each have a plate shape extending in the left-right direction and have a slit 35. The slits 35 open outwardly to the left and right, i.e., in opposite directions, and extend through the supporting pieces 34 in the thickness direction.

The shield connecting member 40 is formed by pressing a metal plate having high conductivity, for example. The shield connecting member 40 has a tin-plated layer (not illustrated) for rust proofing on the surface, for example.

Furthermore, as illustrated in FIG. 1, the shield connecting member 40 includes a horizontally long conductor connecting portion 42, which is long in the left-right direction, and two attachment pieces 43 at the left and right ends of the conductor connecting portion 42. The conductor connecting portion 42 is connected to the upper end portion 41A of the shield conductor 41.

The shield conductor 41 is a flexible conductive metal cloth and is a substantially rectangular sheet formed from woven metal threads. As illustrated in FIG. 1 and FIG. 4, the shield conductor 41 has a sufficient size to collectively cover the electric wire draw-out portions 53 of the housing 50 and the electric wires W, which are drawn out of the electric wire draw-out portions 53, from the rear side. In other words, the shield conductor 41 is slightly larger in the left-right direction than the area including the electric wire draw-out portions 53 and the electric wires W. The shield conductor 41 is attached to the shield connecting member 40 to cover the electric wire draw-out portions 53 and the electric wires W from the rear side.

As illustrated in FIG. 4 and FIG. 5, the conductor connecting portion 42 formed from a horizontally long flat plate, i.e., long in the left-right direction, is folded in half at a bent portion 44, which is located at a substantially middle in the up-down direction, to sandwich the upper end portion 41A of the shield connecting member 41 in the front-back direction.

More specifically, the conductor connecting portion 42 includes an outer sandwiching portion 45 and an inner sandwiching portion 46 such that the bent portion 44 is positioned therebetween. The outer sandwiching portion 45 has a substantially horizontally long rectangular shape, which is long in the left-right direction, and extends along an upper and portion 41A of the shield conductor 41. The inner sandwiching portion 46 has a substantially horizontally long rectangular shape, which is long in the left-right direction, and is adjacent to the upper edge of the outer sandwiching portion 45. In the conductor connecting portion 42 before sandwiching the upper end portion 41A of the shield conductor 41, the inner sandwiching portion 46 extends frontward in a straight line from the bent portion 44, and the conductor connecting portion 42 has an L-like cross-sectional shape.

The upper end portion 41A of the shield conductor 41 is positioned on the front surface of the outer sandwiching portion 45, and then the inner sandwiching portion 46 is folded downward along the bent portion 44. Thus, the upper end portion 41A of the shield conductor 41 is sandwiched between the outer sandwiching portion 45 and the inner sandwiching portion 46 in the front-back direction as illustrated in FIG. 4. Thus, the shield conductor 41 is held by and electrically connected to the shield connecting member 40. Furthermore, as illustrated in FIG. 5, the bent portion 44 has cutouts 47 recessed downwardly in a substantially rectangular shape at a substantially middle in the left-right direction and at positions away from the left end and the right end and slightly closer to the middle, i.e., at a total of three positions.

As illustrated in FIG. 1, the two attachment pieces 43 include contact portions 48 extending frontward from the lateral ends of the outer sandwiching portion 45 of the conductor connecting portion 42 and then extending from the front end to the left and right so as to be away from each other. The attachment pieces 43 include end portions extending further frontward from the contact portions 48. The contact portions 48 of the attachment pieces 43 are in contact with the rear surfaces of the supporting pieces 34 of the shield bracket 30, and the end portions of the attachment pieces 43 are fitted into the slits 35 of the two supporting pieces 34 from the rear side. Thus, the shield connecting member 40 is temporally fixed to the plate body 31. Then, the two supporting pieces 34 and the contact portions 48 are fixed by screws 49 to electrically connect the plate body 31 of the shield bracket 30 and the shield connecting member 40 to each other.

The cover 60 includes a service cover 61 made of synthetic resin and a shell cover 62 made of metal. The service cover 61 covers the operation hole 54 in the tubular portion 51 of the housing 50. The shell cover 62 is attached to the rear surface of the service cover 61.

The service cover 61 has a horizontally long shape, which is long in the left-right direction, and has a fitting portion 63 fitted into the operation hole 54 of the tubular portion 51 from the rear side. A ring-shaped seal ring 64 is fitted to the outer surface of the fitting portion 63. When the fitting portion 63 is fitted into the operation hole 54, the seal ring 64 comes in close contact with the tubular portion 51 and the fitting portion 63 and functions as a water stop between the tubular portion 51 and the fitting portion 63, preventing water or the like from entering the operation hole 54.

Furthermore, as illustrated in FIG. 4, at the front end of the fitting portion 63, an interlock connector 65 configured to be fitted to a receiving-side connector (not illustrated) in the casing C is disposed in a movable manner in the up-down direction and the left-right direction.

The shell cover 62 is formed by pressing a thin metal plate, for example. As illustrated in FIG. 1 and FIG. 4, the shell cover 62 includes a main plate 66, which is larger in the up-down direction and the left-right direction than the tubular portion 51 of the housing 50, and a side plate 67, which extends frontward from an outer peripheral edge of the main plate 66 toward the shield bracket 30.

The main plate 66 has a substantially horizontally long rectangular shape, which is long in the left-right direction, and is large enough to completely cover the tubular portion 51 of the housing 50 from the rear side. As illustrated in FIG. 1 and FIG. 2, a fixing screw 68 is disposed at the substantially middle portion in the up-down direction and the left-right direction of the main plate 66 to connect the service cover 61 and the shell cover 62 to each other. The fixing screw 68 passed through the main plate 66 of the shell cover 62 is tightened on the service cover 61 such that the shell cover 62 is fixed to the rear surface of the service cover 61.

As illustrated in FIG. 1 and FIG. 4, the sideplate 67 extends along the outer peripheral edge of the main plate 66, i.e., along the upper, left, and right edges of the main plate 66. The side plate 67 continuously extends from one lateral edge to the other lateral edge.

As illustrated in FIG. 1, FIG. 2, and FIG. 4, the front end portion of the side plate 67 is a plate contact portion 69 extending in a radial outward direction in a bent form. The plate contact portion 69 is in contact with the rear surface of the plate body 31 of the shield bracket 30 when the cover 60 is attached to the housing 50. The plate contact portion 69 electrically connects the shell cover 62 and the shield bracket 30 to each other.

Furthermore, as illustrated in FIG. 1 and FIG. 2, two fixing pieces 70 extending outwardly from the front edge of the side plate 67 to the left and right are located at substantially middle portions in the up-down direction of the side plate 67. The two fixing pieces 70 each have a substantially rectangular plate shape so as to be in contact with the rear surface of the plate body 31. The fixing pieces 70 are each located at the rear side of the middle bolt insertion hole 33, which is one of the three bolt insertion holes 33 arranged in the up-down direction in the plate body 31.

The fixing pieces 70 each have a through hole (not illustrated) extending through the fixing piece 70 in the front-back direction, which is the thickness direction. A fixing bolt B is inserted into the through hole and tightened on the nut N on the plate body 31 such that the fixing piece 70 is fixed to and electrically connected to the rear surface of the plate body 31. Thus, the cover 60 is fixed to the shield bracket 30.

As illustrated in FIG. 1 to FIG. 4, a lower end portion of the main plate 66 covers the upper half of the outer sandwiching portion 45 of the shield connecting member 40, which is fixed to the shield bracket 30, from the rear side. The lower end portion is referred to as a water blocking wall 71, which covers the bent portion 44 of the conductor connecting portion 42 of the shield connecting member 40 from the left, right, and rear sides.

The water blocking wall 71 is a thin metal plate as the main plate 66 and is longer in the left-right direction than the shield connecting member 40. The water blocking wall 71 has a reinforcing portion 72 protruding to the rear side away from the shield connecting member 40.

The reinforcing portion 72 has a rib-like shape and extends in the left-right direction in a straight line at a position slightly above the lower edge of the water blocking wall 71. The reinforcing portion 72 is larger than the conductor connecting portion 42 of the shield connecting member 40 and is shorter in the left-right direction than the water blocking wall 71.

In short, the bent portion 44 of the conductor connecting portion 42 is covered by the water blocking wall 71 reinforced by the reinforcing portion 72, which is longer in the left-right direction than the bent portion 44.

The present embodiment has the above-described configuration. Next, the process for attaching the shield conductor 41 in a sheet form to the device connector 10 to collectively shield the electric wires W extending from the device connector 10 is briefly described, and the operation and effect of the device connector 10 is also described.

First, in the attachment of the shield conductor 41 to the device connector 10, the shield connecting member 40 having the conductor connecting portion 42 before being bent and the shield conductor 41 are provided.

Here, the conductor connecting portion 42 of the shield connecting member 40 has the inner sandwiching portion 46 extending frontward from the bent portion 44 in a straight line and has an L-like cross-sectional shape. Then, the upper end portion 41A of the shield conductor 41 is placed on the front surface of the outer sandwiching portion 45, and then the inner sandwiching portion 46 is bent frontward along the bent portion 44 such that the upper end portion 41A of the shield conductor 41 is sandwiched between the outer sandwiching portion 45 and the inner sandwiching portion 46 in the front-back direction. Thus, the shield conductor 41 is held by and electrically connected to the shield connecting member 40.

Next, as illustrated in FIG. 5 and FIG. 6, while the shield conductor 41 collectively covers the electric wires W, which are drawn out of the electric wire draw-out portions 53 of the device connector 10 downward, from the rear side, the shield connecting member 40, which is connected to the upper end portion 41A of the shield conductor 41, is fixed to the shield bracket 30 to shield the electric wires W.

Here, first, the contact portions 48 of the two attachment pieces 43 of the shield connecting member 40 are brought into contact with the rear surfaces of the two supporting pieces 34 of the plate body 31 of the shield bracket 30 such that the front end portions of the attachment pieces 43 are fitted into the slits 35 of the two supporting pieces 34 from the rear side. Thus, the shield connecting member 40 is temporally attached to the plate body 31. Then, the two supporting pieces 34 and the contact portions 48 are fixed by the screws 49 to connect and fix the shield connecting member 40 to the shield bracket 30.

This allows the shield conductor 41 to be electrically connected to the shield bracket 30 through the shield connecting member 40 and shields the electric wire draw-out portions 53 and the electric wires W, which are covered by the shield conductor 41 from the rear side.

At the end, the fitting portion 63 of the service cover 61 of the cover 60 is fitted into the operation hole 54 of the tubular portion 51 of the housing 50 to attach the cover 60 to the housing 50. Then, the fixing bolts B are inserted into the fixing pieces 70 of the shell cover 62, which is located at the rear side of the bolt insertion holes 33 of the plate body 31, and then the fixing bolts B are tightened on the nuts N on the plate body 31. Thus, the plate contact portion 69 is electrically connected to the rear surface of the plate body 31, and the fixing pieces 70 are connected and fixed to the rear surface of the plate body 31.

Since the device connector 10 according to this embodiment is attached to the casing C of a device to be mounted in an engine room of a vehicle, the device connector 10 may be exposed to rain water or cleaning water for cleaning the vehicle. Thus, the shield connecting member 40 and the shell cover 62 of the device connector 10 each have a tin-plated layer for rust proofing, for example, on its surface.

However, since the conductor connecting portion 42 of the shield connecting member 40 is bent at the bent portion 44 to sandwich the shield conductor 41, the tin-plated layer on the bent portion 44 may be chipped away when the conductor connecting portion 42 is bent. In such a case, the bent portion 44 of the shield connecting member 40 may get rusted.

However, in this embodiment, as illustrated in FIG. 3 and FIG. 4, the water blocking wall 71, which is the lower end portion of the shell cover 62 of the cover 60, is located on the left, right, and rear sides of the bent portion 44 of the conductor connection portion 42. Thus, the bent portion 44 of the shield connecting member 40 is unlikely to be directly exposed to water when the device connector 10 is exposed to rain water or cleaning water for cleaning the vehicle, for example. For example, compared to a configuration having no water blocking wall and allowing the left, right, and rear sides of the bent portion to be exposed, the bent portion 44 of the shield connecting member 40 in this embodiment is unlikely to get rusted.

Furthermore, in the present embodiment, as illustrated in FIG. 5, the shield connecting member 40 is horizontally long, i.e., long in the left-right direction, and the bent portion 44 of the conductor connecting portion 42 is also long in the left-right direction. The water blocking wall 71 is horizontally long, i.e., long in the left-right direction, to conform to the shape of the bent portion 44 (see FIG. 1 and FIG. 2). In such a configuration, the water blocking wall 71 having a small thickness may be warped and deformed in the thickness direction.

However, in this embodiment, the reinforcing portion 72 protrudes to the rear side at a position slightly above the lower edge of the water blocking wall 71 and has a rib-like shape longer in the left-right direction than the bent portion 44 of the conductor connecting portion 42. This prevents the water blocking wall 71 from being deformed. For example, compared to a configuration having no reinforcing wall resulting in deformation of the water blocking wall, the bent portion 44 of the shield connecting member 40 in this embodiment is unlikely to be directly exposed to water.

In the formation of the reinforcing portion in the water blocking wall, the reinforcing portion may be protruded from the water blocking wall to the front side adjacent to the shield connecting member, or the reinforcing portion may be formed by bending the lower end to the rear side, for example.

However, the reinforcing portion protruding to the front side may protrude too much to the front side. In such case, the reinforcing portion may be in contact with the shield connecting member during the production, for example, preventing the cover from being positioned at the normal position. To prevent the contact with the shield connecting member, the water blocking wall may be moved to the rear side in consideration of the large protrusion. In such a case, the cover has a larger size in the front-back direction. Furthermore, if the lower end is bent to the rear side to form the reinforcing portion, the edge of the lower end protrudes to the rear side. The edge of the lower end may come in contact with and damage another component.

However, in the present embodiment, since the portion slightly above the lower edge of the water blocking wall 71 protrudes to the rear side to form the reinforcing portion 72, the reinforcing portion 72 and the shield connecting member 40 do not come in contact with each other. In addition, the edge of the lower end portion of the water blocking wall 71 does not protrude to the rear side and does not damage another component.

In addition, in the present embodiment, the lower end portion of the shell cover 62 made of metal integrally includes the water blocking wall 71. Thus, the water blocking wall 71 has higher rigidity than a water blocking wall made of synthetic resin, for example. The water blocking wall 71 is further less likely to be deformed.

Other Embodiments

The technology disclosed herein is not limited to the embodiment described above and illustrated by the drawings. For example, the following aspects will be included in the technical scope of the present invention.

(1) In the above-described embodiment, the lower end portion of the shell cover 62 made of metal integrally includes the water blocking wall 71. However, the present invention is not limited to this configuration. The lower end portion of the service cover made of synthetic resin may integrally include the water blocking wall.

(2) In the above-described embodiment, the water blocking wall 71 is longer in the left-right direction than the upper end portion of the main plate 66. However, the present invention is not limited to this configuration. The water blocking wall may have the same length in the left-right direction as the upper end portion of the main plate as long as the length in the left-right direction is longer than that of the bent portion of the shield connecting member.

(3) In the above-described embodiment, the reinforcing portion 72 of the water blocking wall 71 protrudes to the rear side at a position slightly above the lower edge of the water blocking wall 71. However, the present invention is not limited to this configuration. If another component is not disposed on the rear side of the device connector, the lower end portion of the water blocking wall may be bent to the rear side to form the reinforcing portion.

EXPLANATION OF SYMBOLS

10: device connector (shield connector)
30: shield bracket (bracket)
40: shield connecting member
41: shield conductor
42: conductor connecting portion
44: bent portion
50: housing
53: electric wire draw-out portion
60: cover
62: shell cover
71: water blocking wall
72: reinforcing portion
B: fixing bolt
C: casing
W: electric wire

The invention claimed is:

1. A shield connector configured to be attached to a casing of a device and including a bracket made of metal to which a flexible shield conductor made of metal is connected, the shield connector comprising:

a housing fixed to the bracket, the housing including a plurality of electric wire draw-out portions located side by side to draw out electric wires;

a shield connecting member including a conductor connecting portion being a bendable metal plate, the conductor connecting portion being bent to sandwich an end portion of the shield conductor and being connected and fixed to the bracket to electrically connect the shield conductor to the bracket;

a cover covering the housing; and a water blocking wall included in the cover and covering an outer surface of a bent portion of the conductor connecting portion, wherein the bent portion is horizontally long along the shield conductor covering the plurality of electric wire draw-out portions, the water blocking wall has a plate-like shape and is horizontally longer than the bent portion, and the water blocking wall includes a reinforcing portion protruding to an outer side away from the shield connecting member.

2. The shield connector according to claim 1, wherein the reinforcing portion is protruded to the outer side at a position away from an edge of the water blocking wall and closer to the middle.

3. The shield connector according to claim 1, wherein the reinforcing portion is horizontally longer than the bent portion.

4. The shield connector according to claim 1, wherein the cover includes a shell cover made of metal and fixed to the bracket with a fixing bolt, and the shell cover integrally includes the water blocking wall at an end portion.

5. The shield connector according to claim 1, wherein the bracket includes a planar plate body that extends substantially parallel to the water blocking wall.

6. The shield connector according to claim 1, wherein the housing includes a plurality of electric wire draw-out portions located side-by-side to draw out electric wires, and the cover includes a main plate dimensioned to cover the housing, and the water blocking wall is disposed at an end of the main plate.

7. The shield connector according to claim 6, wherein the main plate is thinner than the bracket.

8. The shield connector according to claim 1, wherein areas of the conductor connecting portion adjacent the bent portion are formed with at least one substantially rectangular cutout.

* * * * *